United States Patent [19]

Gaynor

[11] Patent Number: 4,527,274

[45] Date of Patent: Jul. 2, 1985

[54] VOICE SYNTHESIZER

[76] Inventor: Ronald E. Gaynor, 85-55 Little Neck Pkwy., Floral Park, N.Y. 11001

[21] Appl. No.: 535,609

[22] Filed: Sep. 26, 1983

[51] Int. Cl.[3] ..... G10L 1/00

[52] U.S. Cl. ..... 381/51; 84/1.01; 84/1.03

[58] Field of Search ..... 84/1.03; 381/36, 37, 381/38, 41, 42, 43, 44, 45, 46, 47, 48, 49, 50, 51, 52

[56] References Cited

U.S. PATENT DOCUMENTS

| | | | |
|---|---|---|---|
| 3,632,887 | 1/1972 | Leipp | 381/52 |
| 3,704,345 | 11/1972 | Coker et al. | 381/44 |
| 4,278,838 | 7/1981 | Antonov | 381/52 |

*Primary Examiner*—E. S. Matt Kemeny
*Attorney, Agent, or Firm*—Bauer & Amer

[57] ABSTRACT

A voice synthesizer is disclosed for simulating a voice singing the lyrics of a song. The synthesizer comprises a phoneme speech synthesizer in which the phonemes are sounded at a pitch controlled by the keys or notes played on a musical keyboard. The tempo of the sung lyrics is controlled by the tempo at which the keys of the keyboard are played.

20 Claims, 2 Drawing Figures

VOICE SYNTHESIZER

FIELD OF THE INVENTION

This invention relates to a voice synthesizer, and more particularly to such a synthesizer in which the pitch and tempo of the voice is controlled by a musical keyboard so as to simulate singing of a song.

DESCRIPTION OF THE PRIOR ART

The prior art is replete with disclosures of voice synthesizers that simulate the spoken voice, and music synthesizers that produce musical sounds. For example, U.S. Pat. No. 3,367,045 discloses a key operated phonetic sound reproducing device in which individual phonetic sounds are recorded on separate disks, one disk for each phonetic sound, so that when a key representing a particular sound is struck the sound recorded on the associated disk is reproduced. U.S. Pat. No. 4,337,375 discloses a speech synthesizer in which phonemes that go to make up a spoken passage are selected by moving a device such as a light pen over pre-coded representations of the phonemes. U.S. Pat. No. 4,342,244 discloses a musical apparatus that enables a music synthesizer to be controlled by the keys of a musical instrument.

SUMMARY OF THE INVENTION

The present invention provides an apparatus that enables a phoneme voice synthesizer to produce vocal sounds at a controlled pitch and tempo so as to simulate the sung lyrics of a song. Coded signals representing the phonemes that simulate the lyrics are first recorded on a storage medium such as a floppy disk, and then the sequence of phonemes is generated by the phoneme synthesizer in response to the actuation of the keys of a musical keyboard. It is noted that a key or note is played for each syllable of the words of a song and that one or more phonemes may be required to simulate the sound of the syllable. Since each syllable of the lyrics of a song will be generated by a single key actuation, the tempo of the lyrics will be directly controlled by the speed at which the keys are played. The pitch at which a phoneme or phonemes, depending on the constituents of a syllable, is reproduced will be dependent on the key or note played for that syllable.

The object of the present invention is to provide an apparatus that simulates singing the lyrics of a song.

Another object of the invention is to provide an apparatus in which a musical keyboard controls the pitch of the sounds generated by a voice synthesizer.

Still another object of the invention is to provide a system in which a musical keyboard controls the pitch and tempo of the sounds generated by a voice synthesizer.

In carrying out the invention, a data keyboard is provided to enter syllable codes for the phonemes that best simulate the lyrics of a song into the memory of a computer. A musical keyboard recalls the stored phoneme codes and causes a phoneme voice synthesizer to reproduce a phoneme at a pitch determined by the musical key played to recall the phoneme.

Features and advantages of the invention may be gained from the foregoing and from the description of a preferred embodiment of the invention which follows.

DETAILED DESCRIPTION OF THE INVENTION

Before proceeding with the description of the invention, it is to be noted that the system employs a phoneme speech synthesizer produced by the Votrax Division of the Federal Screw Works, Troy, Mich. Specifically, the Votrax SC-01 speech synthesizer is preferred. The data sheet for that synthesizer is incorporated herein by reference, and resort may be had thereto for a complete list of phonemes, their codes, symbols, durations, and example words that enable selection of the proper phonemes to reproduce a vocal sound. The system also employs a Z-80 based computer system, such as the Radio Shack TRS-80, for storage of phoneme codes that make up the lyrics of a song and for control of the data flow through the system under control of the keys of a musical keyboard. The computer system will be referred to hereinafter as the host computer.

Figure 1:
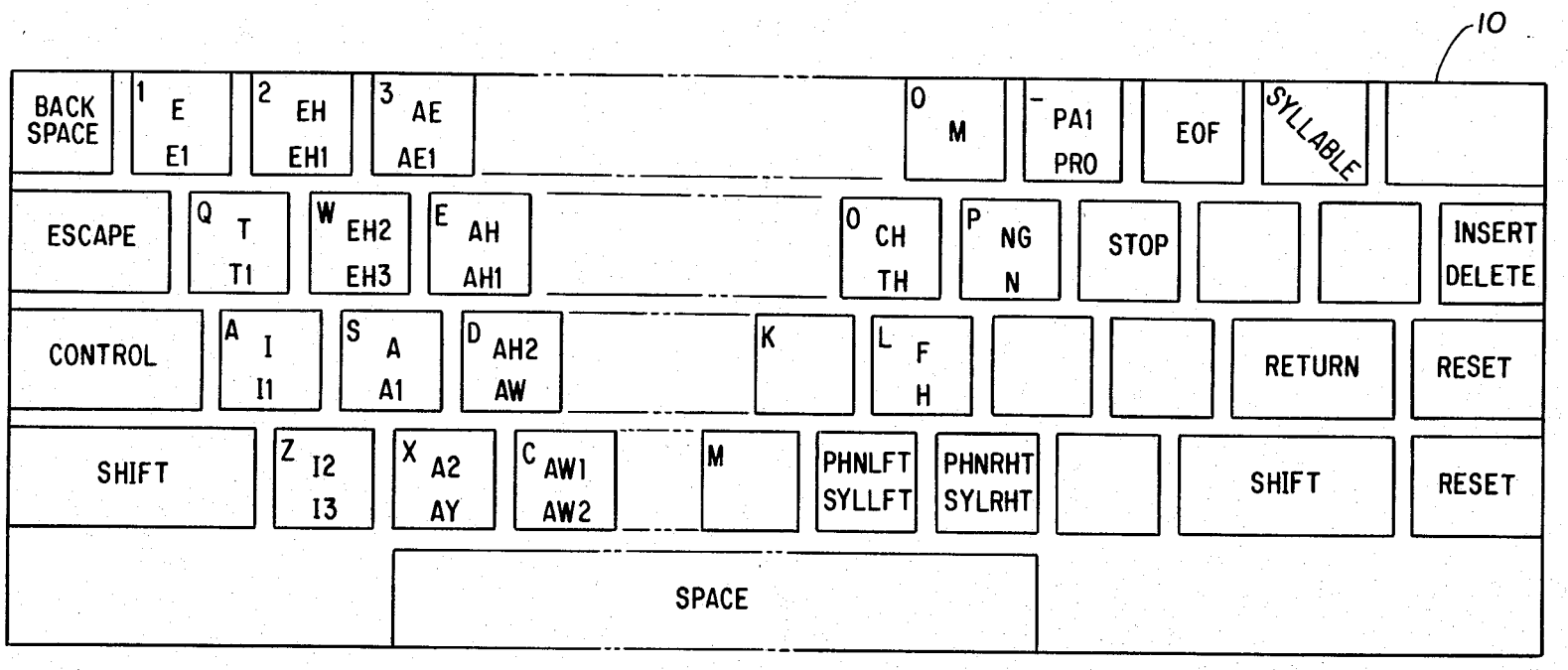
FIG. 1 is a schematic illustration of the data input keyboard with a phoneme symbol overlay sheet showing several phoneme and control signal indicia applied to several keys.

Referring now to the drawing, a data input keyboard 10, which may be an RCA VP-601 ASCII keyboard, is shown connected to the host computer 11 which is programmed to respond to the actuation of the keys of keyboard 10. Initially host computer 11 will be in a control mode ready to accept commands from keyboard 10. This will be indicated by computer monitor 12 displaying the word "Ready" on its screen. The commands that may be entered into the system are: "New", "Old", "Save", "Replace", "Run", and "Catalog", and they are entered simply by typing the keys bearing the letter indicia that spell out the commands. Referring to FIG. 1, the indicia for which the keys will enter an ASCII code representing the letters are shown in the upper left hand corners of the keys. When computer 11 is in a data entry mode, as distinct from the control mode, actuation of the keys will result in the entry of codes representing the phoneme symbols shown in the center of the keys. The computer will be in the data entry mode when either of the commands, "New" or "Old" are entered. In other words, after a command "New" or "Old" is entered, subsequent actuation of the keys will result in phoneme codes being entered into the computer memory. Other function or editing control signals may be entered by actuation of suitably marked keys. The phoneme and editing indicia for the keys may be provided by an overlay sheet, or the keys may be altered to indicate their phoneme as well as their conventional ASCII coding function.

Assume that it is desired to record the lyrics of the song, "A Bicycle Built for Two", and that the monitor 12 displays the word "Ready" to indicate that the system is in the control mode. The operator will then type the word "New" and depress the "Return" key, whereupon the monitor will request the operator to enter a filename or identification for the phoneme codes thereafter to be entered. The identifying filename will then be entered by actuating the keyboard keys according to their conventional markings. The monitor 12 will then display the filename and the control mode in effect. In the present example, this mode is "New". At this point, computer 11 is programmed to operate in the data entry mode so as to interpret subsequent key strokes as phoneme or editing signals.

In the song referred to above, the first word is "Daisy". This word must be translated to phonemes by using the Votrax SC-01 speech synthesizer data sheet. The word "Daisy" consists of two syllables, each of which may contain more than one phoneme. Thus, the syllable "dai" may consist of the phonemes represented by the symbols (taken from the Votrax SC-01 data sheet) D, A1, I3, and Y, and the syllable "sy" of the phonemes represented by the symbols S, Z, E1, E, and Y. In entering the codes for the word "Daisy" into computer 11, the operator first strikes the key labeled "Syllable". This is indicated on monitor 12 by a double slash symbol. Next, the four keys identified by the phoneme indicia D, A1, I3, and Y are depressed followed by the "Syllable" key which, in effect, terminates the first syllable. The monitor displays a double slash symbol, followed by four phoneme symbols, followed by a double slash symbol. Each succeeding syllable of the song lyrics is similarly entered into the memory of computer 11. As the syllables for the lyrics of the song are coded as described, monitor 12 displays the symbols therefor. Thus, the operator will have a complete display of the phonemes he has selected for the words of the song. He can add, subtract, or alter phoneme codes by normal computer editing techniques. This can be done while the phoneme codes are in a temporary or transient memory and preferably before the codes are transferred to a floppy disk memory under the filename originally given to the sequence of codes.

If the phoneme codes stored in the temporary memory and displayed on monitor 12 are acceptable, and it is desired to transfer the codes to the floppy disk memory, the end of file key "EOF" is actuated. Computer 11 goes into the control mode and monitor 12 displays the word "Ready". The transfer of codes to the floppy disk is then effected when the "Save" command is given by actuating the keys that spell out the word "Save", but before the transfer is actually effected, computer 11 will request entry of a filename by displaying the words "Enter filename" on monitor 12. The operator will then type the filename, and if it is not on the disk, the computer will respond to the "Save38 command by transferring the phoneme codes from the temporary memory to the floppy disk. If the filename is on the floppy disk, the computer will respond by having monitor 12 display the message "File already saved, type 'Replace' to overwrite". Typing the "Replace" command will cause the phoneme codes in the temporary memory to overwrite, i.e., replace, the phoneme codes stored in the floppy disk under the filename.

After the phoneme codes have been recorded on the floppy disk, they can be changed, deleted, or added to in ways well known in the computer art. Also, it is to be understood that the operator instructions that appear on the monitor 12 may vary in accordance with standard programming techniques. Many programs written around the entering of phoneme data would be suitable for the practice of the present invention, hence, no attempt has been made to specify a precise program for entering data into computer 11. Other conventional techniques, such as displaying a catalog of filenames so as to inform an operator of all the names of the songs stored on the floppy disk may be employed. Such a list may be called up by actuating the keys that spell out the word "Catalog" or its abbreviation when computer 11 is in the control mode. Similarly, when in the control mode, keying the word "Old" followed by a filename will result in the display of the phoneme symbols for the phoneme codes stored under that filename.

When the operator wishes the apparatus to sing a recorded song under the control of the musical keyboard 13, he simply keyboards the word "Run" followed by a filename on data keyboard 10, whereupon the contents of that file are copied into a temporary memory in computer 11. It is understood, of course, that the codes for that file also remain stored on the floppy disk.

Figure 2:
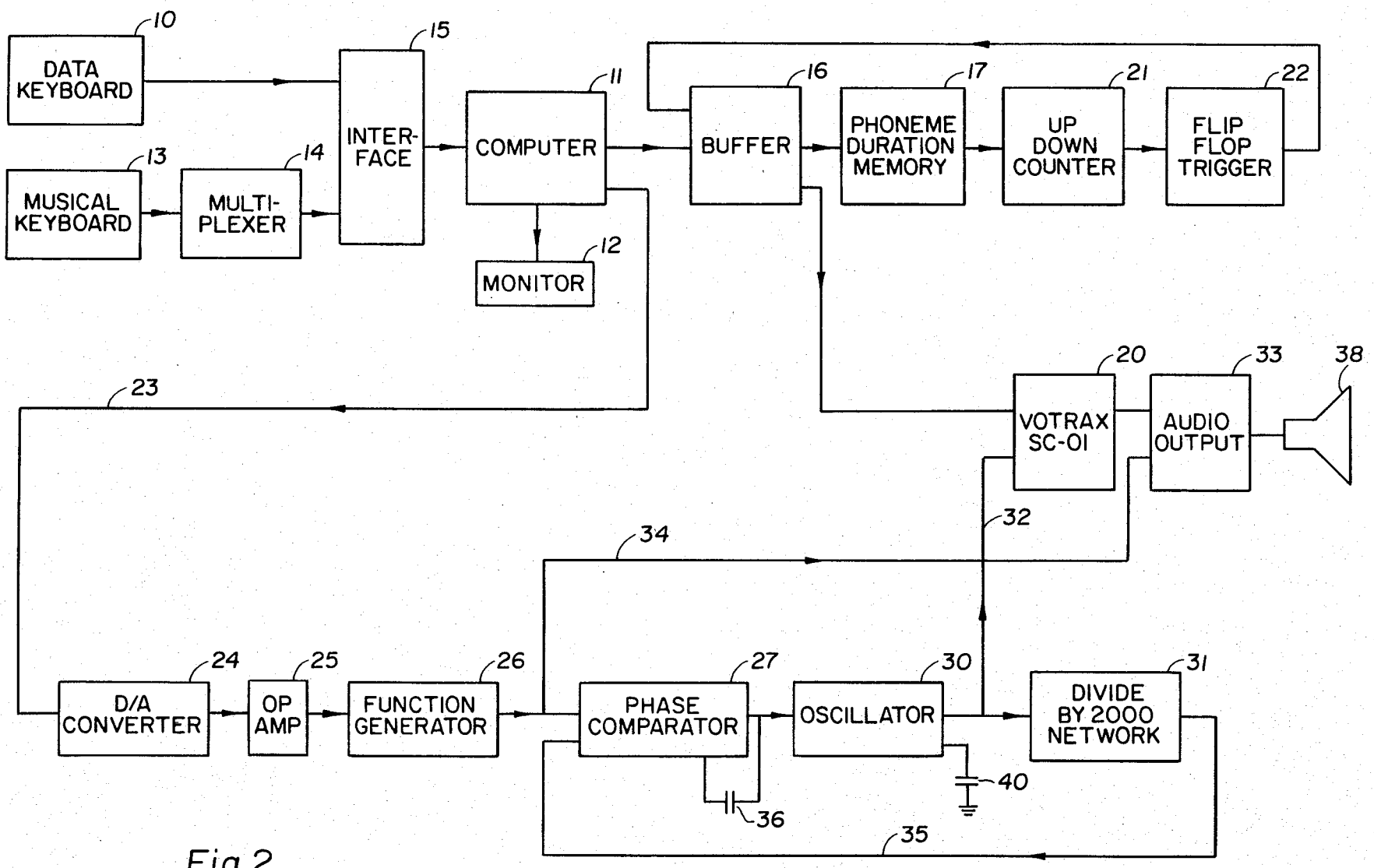
FIG. 2 is a schematic block diagram showing the principal components of the present invention.

Attention is now directed to FIG. 2 of the drawing. Assume that data keyboard 10 has been operated to transfer the phoneme codes for the phonemes that make up the words of a song from the floppy disk to the temporary memory of computer 11. Now the operator will depress one of the eighteen keys of musical keyboard 13. The keyboard may be a Pratt-Read AGO-18 eighteen note keyboard. Sensing which one of the keys of keyboard 13 is depressed is performed by multiplexer 14 which comprises three National Semiconductor CD4051BCN chips. Information as to the particular key depressed is fed to interface chip 15 (Mostek MK3881) where the same information is detected by computer 11 which continuously scans interface 15 for data. When computer 11 detects the depression of a musical key it immediately transfers the string of phoneme codes making up a syllable from its temporary memory to buffer 16. The latter comprises two Advanced Micro Devices AM3341APC chips. The computer also generates another code that corresponds to the frequency of the note represented by the depressed key. As will be seen hereinafter, this frequency code will control the pitch at which the phonemes making up the syllable will be sung.

The phoneme codes that are fed to buffer 16, which consists of two sixty-four bit first in first out registers, are transferred sequentially from the buffer to a programmable read only memory (two National Semiconductor DM745288N chips) in which is stored the phoneme duration time for each of the sixty-four Votrax phonemes. The phoneme codes are fed from buffer 16 also to Votrax chip 20 which comprises the entire Votrax SC-01 speech synthesizer. The phoneme duration value for the phoneme code appearing at the output of buffer 16 is taken from the programmable memory 17 and set in up-down counter 21 (Texas Instrument SN74LS169N) which then proceeds to count down at a 1 KHz rate. When counter 21 counts down to zero, flip flop 22 triggers buffer 16 so that the next phoneme code appears at its output. The code is transfererd to Votrax chip 20 and to the read only memory 17 from where the phoneme duration is read to set counter 21. The process will continue until all of the phoneme codes stored in buffer 16 are sequentially fed to the Votrax chip 20, each code appearing for the programmed time assigned to the phoneme. The phoneme will be vocally sounded at a pitch determined by the musical key or note that was played to transfer the phoneme codes from the temporary memory of computer 11 to buffer 16. The circuitry for controlling the pitch of the vocalized phonemes is still to be described.

The number of phoneme codes transferred from computer 11 to buffer 16 at any one time will depend on the number of phonemes that go to make up a syllable as previously indicated. In other words, each time a musical key is played, a string of phoneme codes composing a syllable that is to be voiced at a pitch corresponding to the note are transferred to buffer 16. Once the phoneme codes are stored in buffer 16, they will be transferred to Votrax chip 20 at times controlled by the phoneme duration times stored in read only memory 17, and they will be vocalized at a pitch determined by the musical key depressed.

The Votrax chip contains a master clock which generally determines phoneme pitch and timing and formant generation of the phoneme, but since the present invention contemplates the phonemes being voiced to simulate singing of the lyrics of a song rather than spoken words, circuitry is provided to vary the pitch of vocalized phonemes in accordance with the musical key depressed to call for those phonemes.

As mentioned hereinabove, when computer 11 senses a depressed musical key it generates a code representing the frequency of the note associated with the key. For example, if the A key above middle C is played, computer 11 will determine this and will look up the frequency for the note in its note frequency memory. From this memory it is found that the A key has a frequency of 440 Hz. Since the musical keyboard has eighteen keys, the note frequency memory will store eighteen frequencies, one for each key or note. The frequency values will range from 261 Hz to 698 Hz.

Thus, when a musical key is depressed, a digital note frequency signal is sent over line 23 to digital to analog converter 24 which generates a current corresponding to the note frequency. This converter is a National Semiconductor DAC1000LCN ten bit converter. Operational amplifier (National semiconductor LM747CN) 25, in turn, converts the current to a voltage signal, again proportional to the note frequency. The voltage signal will then control function generator 26, Exar Integrated Systems XR2206CN, which produces a sign wave output at a frequency corresponding to the frequency of the note. Thus, function generator 26 will produce a sine wave output having a frequency range of 261 Hz to 698 Hz.

The pitch control clock which will control the pitch of the phonemes vocalized by Votrax chip 20 is made up of phase comparator 27 (National Semiconductor CD4046BCN, free running oscillator 30, and divide by 2000 network 31. The timing of phoneme duration is controlled by phoneme duration memory 17 and the rate at which counter 21 counts to control the transfer of phoneme codes from buffer 16 to Votrax chip 20. It is only the phoneme pitch that is controlled by the clock circuit now to be described. Thus, the Votrax chip master clock, which generally controls formant generation, phoneme timing, and phoneme pitch, will in the present system control only formant generation in response to the phoneme codes transferred to Votrax chip 20 from buffer 16. Since the phonemes will be formed under control of the Votrax master clock their sounds will not be distorted.

Assume that Votrax chip 20 is to sing a phoneme or phonemes when the A note key of keyboard 13 is depressed. As indicated above, depression of that key results in a 440 Hz signal being generated by function generator 26. However, sounding a phoneme at this pitch would be objectionable since 440 Hz is beyond the range of the Votrax speech synthesizer. To remain within its vocal range and still harmonize with the reference tone of 440 Hz, the Votrax chip will be tuned to sound a phoneme at a pitch one quarter that of the note played, in the present example 110 Hz, which is within the usable singing range of 50 Hz to 200 Hz.

It will be assumed that oscillator 30 operates at 880 KHz and that any clock signal transmitted over line 32 to Votrax chip 20 is divided by 8000 by internal chip circuitry. Thus, while oscillator 30 is operating at 880 KHz, a phoneme will be sounded at a pitch of 880 KHz divided by 8000 or 110 Hz. At the same time, the 440 Hz pitch control signal from function generator 26 is transmitted directly to the audio output components 33 and loudspeaker 38 over line 34. Therefore, the audio output of the present song synthesizer will consist of the harmonizing musical note signal transmitted over line 34 and the phoneme sounded at a pitch related to the musical note.

More particular attention is now directed to phase comparator 27, oscillator 30, and divide by 2000 network 31. The latter network incidentally comprises three Texas Instrument SN74LS161N binary counters. Assume that as the result of a note signal of 440 Hz from function generator 26 to phase comparator 27, oscillator 30 is generating clock pulses at a rate of 880 KHz. These pulses are fed to Votrax chip 20 where they are divided by 8000 to provide a phoneme pitch of 110 Hz. They are also fed to divide by 2000 network 31 which transmits, over line 35, pulses at a rate of 440 Hz to phase comparator 27. Since both input signals to phase comparator 27 are at a rate of 440 HZ, the circuitry just described operates stably at the frequency indicated.

Assume now that a musical key is depressed resulting in function generator 26 producing an output signal of 330 Hz which is transmitted to phase comparator 27. Since the input to phase comparator 27 from network 31 is 440 Hz, the comparator output causes capacitor 36 to discharge. This in turn causes timing capacitor 40 (which is a component of oscillator 30) to charge more slowly and thus decrease the clock frequency from 880 KHz. As the clock frequency decreases to 660 KHz, divide by 2000 network 31 delivers a 330 Hz signal to phase comparator 27, and since at that time both input frequencies to comparator 27 are identical, even if out of phase with each other, the circuitry will remain stable with oscillator 30 producing a clock signal of 660 KHz. This signal will go to Votrax chip 20 where it is divided by 8000 resulting in a phoneme pitch of approximately 82.5 Hz. Of course, the opposite effect takes place when a higher frequency note is played after a lower frequency note.

It will be noted that depression of a musical key causes a syllable to be sung, and that the syllable may consist of a plurality of phonemes. Thus, when a musical key is depressed, a tone signal of the note frequency will be directed to audio output components over line 34 and a phoneme pitch signal related to the tone signal will be transmitted to Votrax chip 20 over line 32 so that all of the phonemes included in the syllable will be voiced at a harmonizing pitch. Depression of a second musical key will result in the singing of a second syllable.

Having thus described the invention, it is to be understood that other embodiments thereof, differing from the preferred embodiment described, could be provided without departing from the spirit and scope of the invention. Moreover, certain additional circuits could be incorporated to provide other features to the invention. Thus, input jacks could be provided in parallel with the musical keyboard 13 and multiplexer 14 so that the timing of the syllable sequence could be triggered by an external signal. In such case, the pitch control signal would be introduced to phase comparator 27 and audio output 33 through jacks instead of from function generator 26 as in the preferred embodiment described. Also, a joystick type control lever could be provided to vary slightly the output of operational amplifier 25 and thus effect a modification of the musical frequency for a note that has been programmed into the system. The joystick lever can also control the phoneme duration time by speeding up or slowing down the rate at which counter 21 operates to deliver phoneme duration data to Votrax chip 20. Therefore, it is intended that the foregoing specification and the accompanying drawing be interpreted as illustrative rather than in a limiting sense.

What is claimed is:

1. A voice synthesizer for simulating a voice singing the lyrics of a song comprising: a speech synthesizer for electronically producing spoken words in response to coded signals representing word syllables; record means for storing coded signals representative of the syllables of the words of a song; data keyboard means for entering coded signals representative of the syllables of the words of a song into said record means; musical keyboard means for playing the notes of a melody; means responsive to said musical keyboard means for transferring coded signals from said record means to said speech synthesizer, said responsive means transferring one coded syllable signal for each musical note played; and pitch control means responsive to the musical note played by said musical keyboard means for controlling the pitch at which said speech synthesizer produces the syllables of the words of a song.

2. A voice synthesizer according to claim 1 wherein said speech synthesizer is a phoneme speech synthesizer in which each syllable of a spoken word comprises one or more phonemes, wherein each coded signal represents a phoneme, wherein said responsive means transfers the phoneme codes composing a word syllable from said record means to said speech synthesizer for each musical note played on said musical keyboard means, and wherein the phonemes that compose a syllable are sounded at the pitch determined by the musical note played to transfer the phoneme codes to said speech synthesizer.

3. A voice synthesizer according to claim 2 wherein said pitch control means includes note frequency means that generates a pitch signal corresponding to the note played on said musical keyboard means, and oscillator means responsive to said pitch signal and connected to said speech synthesizer for causing said speech synthesizer to sound phonemes at a pitch related to the pitch signal.

4. A voice synthesizer according to claim 3 wherein said speech synthesizer includes phoneme signal generating means and audio means that produce the audible sounds of said speech synthesizer and including means for delivering said pitch signal to said audio means for producing an audible sound that is harmonious with audible sounds of the phonemes that are sounded at a pitch related to the pitch signal.

5. A voice synthesizer according to claim 4 including manually operated means to vary the pitch signal derived from said note frequency means.

6. A voice synthesizer for simulating a voice singing the lyrics of a song comprising: a phoneme speech synthesizer for producing electrical signals corresponding to phoneme sounds; audio output means connected to said speech synthesizer for producing audible phoneme sounds; record means for storing coded signals respresentative of phonemes; data keyboard means for entering coded signals representative of the phoneme sounds that make up the lyrics of a song, said signals being grouped in syllables that correspond to the syllables of the words of the lyrics, into said record means; musical keyboard means for playing the notes of a melody; means responsive to actuation of a key of said musical keyboard means for transferring a group of coded phoneme signals that make up a syllable from said record means to said speech synthesizer; and pitch control means responsive to actuation of a key of said musical keyboard means for controlling the pitch at which the group of phonemes corresponding to the phoneme signals transferred to said speech synthesizer are sounded.

7. A voice synthesizer according to claim 6 wherein said responsive means for transferring phoneme signals to said speech synthesizer includes a buffer means where a group of phoneme signals composing a syllable are stored, and phoneme duration timer means for timing the transfer of phoneme signals from said buffer means to said speech synthesizer.

8. A voice synthesizer according to claim 7 wherein each actuation of a key of said musical keyboard means causes a group of phoneme code signals making up a syllable to be transferred from said record means to said buffer means.

9. A voice synthesizer according to claim 8 wherein said phoneme duration timer means includes a memory means in which duration time for each phoneme is stored, counter means set in accordance with the duration time of a phoneme the signal for which has been transferred to said speech synthesizer, clock means for counting down said counter means at a prescribed rate, and trigger means for transferring the succeeding phoneme code to said speech synthesizer and the duration time therefor to said counter means when said counter means is reset to zero.

10. A voice synthesizer according to claim 9 including means for adjusting said clock means to operate at a different rate.

11. A voice synthesizer according to claim 10 wherein said pitch control means includes note frequency generator means for generating a frequency signal corresponding to the note played on said musical keyboard means, means for modifying the frequency signal generated by said note frequency generator means, and means for feeding said modified frequency signal to said speech synthesizer so that said phonemes are sounded at a pitch corresponding to said modified signal.

12. A voice synthesizer according to claim 11 wherein said speech synthesizer includes audio means that produce the audible sounds of said synthesizer, and including means for delivering the frequency signal corresponding to a note directly to said audio means.

13. A voice synthesizer according to claim 12 including manually operable means for altering the frequency signal generated by said note frequency generator means.

14. A voice synthesizer according to claim 9 wherein said pitch control means includes note frequency generator means for generating a frequency signal corresponding to the note played on said musical keyboard means, means for modifying the frequency signal generated by said note frequency generator means, and means for feeding said modified frequency signal to said speech synthesizer so that said phonemes are sounded at a pitch corresponding to said modified signal.

15. A voice synthesizer according to claim 14 wherein said speech synthesizer includes audio means that produce the audible sounds of said synthesizer, and including means for delivering the frequency signal corresponding to a note directly to said audio means.

16. A voice synthesizer for simulating a voice singing the lyrics of a song comprising: a speech synthesizer for electronically producing spoken words in response to coded signals representing word syllables; record means for storing coded signals representative of the syllables of the words of a song; data keyboard means for entering coded signals representative of the syllables of the words of a song into said record means; musical keyboard means for playing the notes of a melody; and means responsive to said musical keyboard means for transferring coded signals from said record means to said speech synthesizer, said responsive means transferring one coded syllable signal for each musical note played, whereby the tempo of the words produced by said speech synthesizer is controlled by said musical keyboard means.

17. A voice synthesizer according to claim 16 wherein said speech synthesizer is a phoneme speech synthesizer in which each syllable of a spoken word comprises one or more phonemes, wherein each coded signal represents a phoneme, and wherein said responsive means transfers the phoneme codes composing a word syllable to said speech synthesizer for each musical note played on said musical keyboard means.

18. A voice synthesizer according to claim 17 wherein said responsive means includes buffer means in which phoneme codes composing a word syllable are temporarily stored, and a phoneme timing means for transferring phoneme codes from said buffer means to said speech synthesizer at a time dependent on the duration for which a phoneme should be sounded.

19. A voice synthesizer according to claim 18 wherein said phoneme timing means includes memory means in which the duration time for each phoneme is stored, counter means to count the time each phoneme is to be sounded, and trigger means for triggering the transfer of a phoneme code from said buffer means to said speech synthesizer after the duration time for the preceeding phoneme has expired.

20. A voice synthesizer according to claim 19 including manually operable means for adjusting the rate at which said counter means counts.

* * * * *